United States Patent [19]

Bellis

[11] Patent Number: 5,070,370

[45] Date of Patent: Dec. 3, 1991

[54] IMAGE-FORMING APPARATUS HAVING A REPLACEABLE CARTRIDGE AND A TRANSFER MEMBER CLEANING DEVICE

[75] Inventor: Edson F. Bellis, Macedon, N.Y.

[73] Assignee: Eastman Kodak Company, Rochester, N.Y.

[21] Appl. No.: 632,710

[22] Filed: Dec. 24, 1990

[51] Int. Cl.[5] ..... G03G 15/14

[52] U.S. Cl. ..... 355/271; 355/298; 355/327

[58] Field of Search ..... 355/200, 210, 271, 298, 355/326, 327, 260

[56] References Cited

U.S. PATENT DOCUMENTS

| | | | |
|---|---|---|---|
| 3,847,119 | 11/1974 | Hoffman et al. | 118/637 |
| 4,026,648 | 5/1977 | Takahashi | 355/209 |
| 4,453,820 | 6/1984 | Suzuki | 355/279 |
| 4,607,941 | 8/1986 | Honda | 355/210 |
| 4,712,906 | 12/1987 | Bothner | 355/271 |
| 4,862,224 | 8/1989 | Ku | 355/200 |
| 4,876,577 | 10/1989 | Ogura et al. | 355/315 |
| 4,891,676 | 1/1990 | Davis et al. | 355/271 |

*Primary Examiner*—A. T. Grimley
*Assistant Examiner*—P. Stanzione
*Attorney, Agent, or Firm*—Leonard W. Treash, Jr.

[57] ABSTRACT

An image-forming apparatus, for example, electrophotographic printer has a replaceable cartridge which includes an image member, for example, a rotatable photoconductive drum. The drum cooperates with a transfer member, for example, a transfer drum which transfer member must be cleaned. The cartridge includes a chamber for receiving toner cleaned from the transfer member. Preferably, the image-forming apparatus creates a series of color toner images which are transferred to the surface of the transfer member in registration to create a multicolor image. The multicolor image is transferred in turn to a receiving sheet. The residual toner on the transfer member can be cleaned either by a cleaning device permanently located in the apparatus or a cleaning device in the cartridge. In either instance, the toner is collected in the cartidge and therefore does not require separate maintenance beyond replacement of the cartridge.

20 Claims, 3 Drawing Sheets

IMAGE-FORMING APPARATUS HAVING A REPLACEABLE CARTRIDGE AND A TRANSFER MEMBER CLEANING DEVICE

FIELD OF THE INVENTION

This invention relates to image-forming apparatus of the type which includes a replaceable cartridge, for example, a cartridge containing a photoconductive drum. It also relates to image-forming apparatus which includes an endless transfer member, for example, a transfer drum, which transfer member must be cleaned.

BACKGROUND ART

U.S. Pat. No. 3,847,119, Hoffman et al, issued Nov. 12, 1974, is typical of a large number of references showing a transfer drum or roller for assisting in transfer of a toner image to a receiving sheet from a photoconductive image member. To prevent soiling of the reverse side of the transfer sheet, the transfer roller is continuously cleaned by a fur brush and the particles of toners so cleaned are removed by a vacuum source. See also, U.S. Pat. No. 4,026,648, Takahashi, issued May 31, 1977 showing a blade cleaner for a transfer roller.

U.S. Pat. No. 4,453,820, Suzuki, issued June 12, 1984 is representative of a number of references which show an intermediate transfer member to which a toner image is transferred from the original image member, and from which the toner image is then transferred directly to a receiving sheet. Unless transfer to the receiving sheet is 100% effective, the surface of such a transfer member must be cleaned before a new toner image is transferred to it. See also, Bothner, U.S. Pat. No. 4,712,906, issued Dec. 15, 1987.

U.S. Pat. No. 4,876,577, Ogura et al, issued Oct. 24, 1989 is representative of a number of references which show an image-forming unit into which a cartridge is loaded. The cartridge includes a photoconductive drum, a blade cleaning device for the drum, a charger and access to the drum for both toning and transfer of images. Including the cleaning device for the photoconductive as part of the cartridge eliminates the need for operator disposal of residual toner cleaned off the photoconductive drum. The residual toner left in the cartridge can be disposed of or recycled when the cartridge is returned to the factory for recycling of the photoconductive drum.

U.S. Pat. No. 4,862,224, granted to Ku, on Aug. 29, 1989, shows a roller cleaning device for a transfer drum. The cleaning roller is made of a material attractive to toner and is biased relative to the transfer drum to create an electric field attracting toner to the cleaning roller. The roller is articulatable in and out of contact with the transfer drum so that the apparatus can superpose a plurality of single color images on a receiving sheet carried by the transfer drum to make a multicolor image. A blade is spring-biased against the cleaning roller to clean toner off of the roller into a container associated with the roller. The container is either emptied or replaced periodically.

DISCLOSURE OF THE INVENTION

It is an object of the invention to reduce the inconvenience of disposing of residual toner cleaned off a transfer member.

This and other objects are accomplished by providing an image-forming apparatus of the type which includes a transfer member. A replaceable cartridge, for example, one containing an image member, is supplied to the apparatus. To eliminate the inconvenience of disposing of toner cleaned off the transfer member, the replaceable cartridge also includes a sump for receiving such toner.

According to a preferred embodiment, the transfer drum is cleaned by an articulating cleaning mechanism which is permanent in the image-forming apparatus and the cartridge includes a chamber for receiving toner cleaned off by that cleaning mechanism which chamber includes an opening which is positioned directly below the cleaning mechanism.

According to an alternative preferred embodiment, the cartridge not only includes an image member, it includes means for cleaning the transfer member as well as means for receiving and containing the residual toner cleaned from the transfer member.

Thus, it is another object of the invention to provide a cartridge for an endless image member which cartridge also performs the function of receiving residual toner cleaned off a transfer member.

With this invention, residual toner cleaned off the transfer member does not need to be separately disposed o in servicing the image-forming apparatus. Like the toner cleaned off the photoconductive member in the prior art cartridge, the toner cleaned off the transfer member is returned to the factory for disposal or reuse when the image member is recycled.

BRIEF DESCRIPTION OF THE DRAWINGS

In the detailed description of the preferred embodiment of the invention presented below, reference is made to the accompanying drawings, in which.

DISCLOSURE OF THE PREFERRED EMBODIMENT

Figure 1:
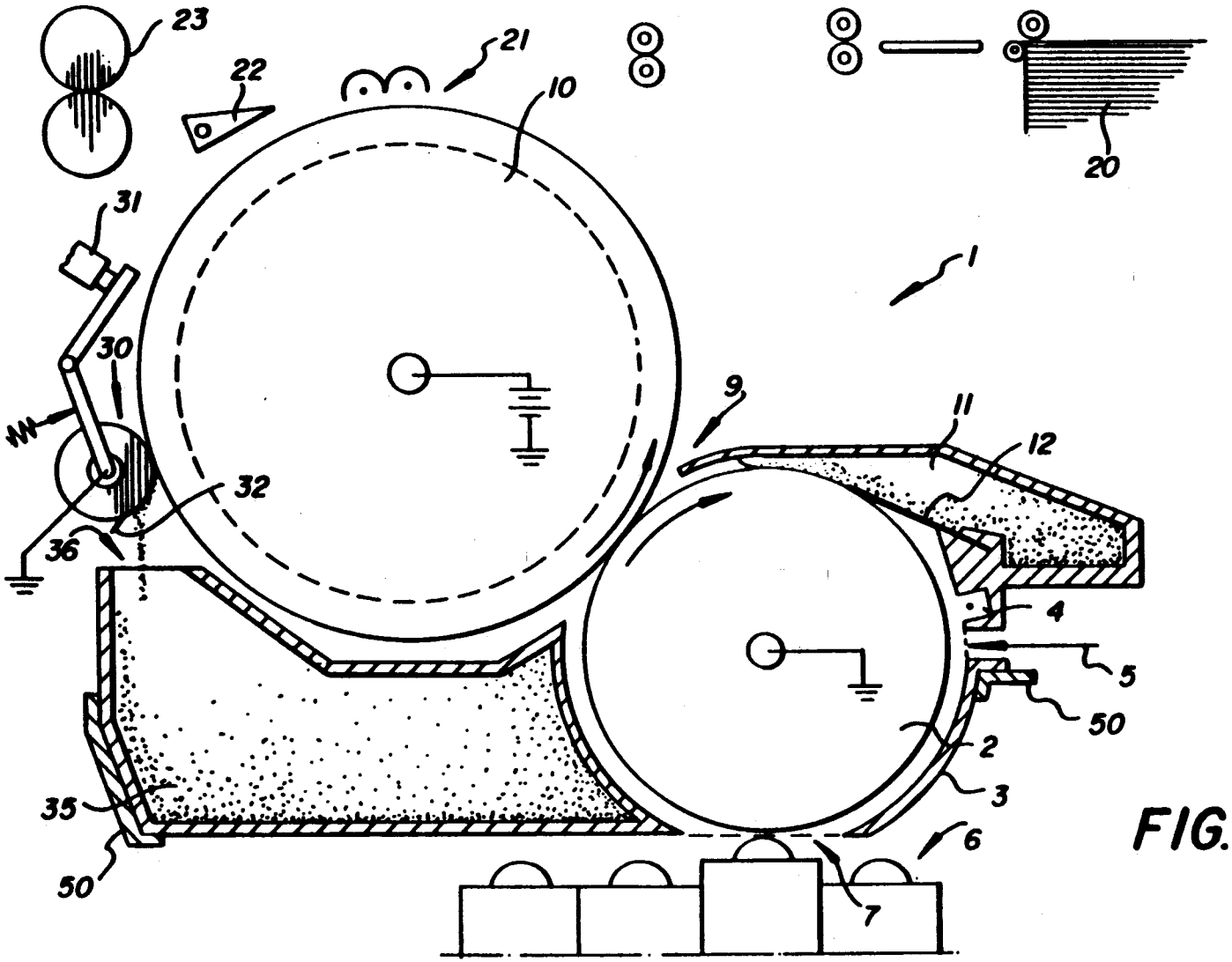
FIG. 1 is a front schematic of an image-forming apparatus constructed according to the invention.

Referring to FIG. 1, image-forming apparatus, for example, an electrophotographic printer 1 includes means 50 for receiving a cartridge 3. Cartridge 3 includes an image member, for example, photoconductive drum 2 journaled on its axis for rotation bringing its outer surface past a series of electrophotographic stations.

Photoconductive drum 2 is first uniformly charged at a charging station 4 and imagewise exposed at an exposure station, for example, by a laser 5, through an opening in cartridge 3. Laser 5 is controlled to create a series of electrostatic images on the surface of drum 2 which electrostatic images correspond to color separations or highlight color components of a desired multicolor print.

The series of electrostatic images are toned with toners of different color by a development station 6. Development station 6 includes a plurality of development units which are sequentially positioned in development relation with the periphery of drum 2 to apply different color toners to each image of the series of electrostatic images. An opening 7 in cartridge 3 provides access to drum 2 for toning station 6.

The different color toner images are transferred in registration to the cylindrical outside surface of a transfer drum 10. An opening 9 in cartridge 3 provides access to drum 2 for transfer drum 10. The transfer drum 10 and the photoconductive drum 2 can be driven by appropriate drive means, not shown, well known in the art and not part of this invention.

With each revolution of transfer drum 10 a separate single color toner image is transferred in registration with the previous toner images to create a multicolor image on its periphery. The multicolor image is transferred at a conventional corona transfer station 21 (or, alternatively, a roller transfer station) to a receiving sheet fed from a receiving sheet supply 20. The receiving sheet is picked off the surface of transfer drum 10 by a sheet pick-off 22 which also guides the sheet to a fuser 23 and hence to an output tray, not shown.

Photoconductive drum 2 is continuously cleaned by cleaning blade 12 with the toner collecting in a residual toner chamber 11 in cartridge 3.

Unless transfer of toner to the receiving sheet at transfer station 21 is 100% complete, transfer drum 10 also needs to be cleaned. Accordingly, a cleaning roller 30 is positioned adjacent the surface of transfer drum 10. Because transfer drum 10 requires several revolutions to form a multicolor image, cleaning roller 30 is articulatable out of contact with transfer drum 10 by a solenoid 31 during image transfer and permitted to return under spring bias into cleaning contact with the transfer drum 10 after the multicolor image has been transferred at transfer station 21. During contact with transfer drum 10, toner is cleaned off drum 10 by a combination of choice of materials for cleaning roller 30 and an electric field urging toner to cleaning roller 30 which field is applied between cleaning roller 30 and drum 10. Toner is cleaned off cleaning roller 30 by a cleaning blade 32. For more details of a similar cleaning roller for a transfer drum, see U.S. Pat. No. 4,862,224, to Ku, issued Aug. 29, 1989, the disclosure of which patent is incorporated by reference herein.

In the Ku cleaning structure, toner cleaned off the cleaning roller 30 is deposited in a sump which forms a housing for the cleaning roller. This sump must be emptied or replaced periodically which requires additional servicing. Note that the Ku cleaning mechanism is designed to clean a transfer roller which holds a transfer sheet on its periphery. It therefore cleans considerably less toner from the surface of the transfer drum than is cleaned by cleaning roller 30 in FIG. 1.

To reduce additional servicing, according to FIG. 1, cartridge 3 includes a sump 35 having an opening 36 at its top which opening is positioned to receive toner cleaned off cleaning roller 30. For this purpose, opening 36 is positioned below the engagement of roller 30 with blade 32. Thus, when cartridge 3 is returned for recycling of photoconductive drum 2, both chambers 11 and 35 contain toner which can be recycled or disposed of. Thus, printer I, requires no disposal of cleaned residual toner, cleaning filters, or the like, separate from already required replacement of cartridge 3.

Opening 36 can be provided with a cover, not shown, which is openable before insertion of cartridge 3 or as part of insertion of cartridge 3 in the printer 1. It can be spring biased to a closed position to which position it moves as the cartridge is removed. Alternatively, a tape can be provided to the operator for use when removing the cartridge, which tape is placed by the operator over opening 36.

Figure 2:
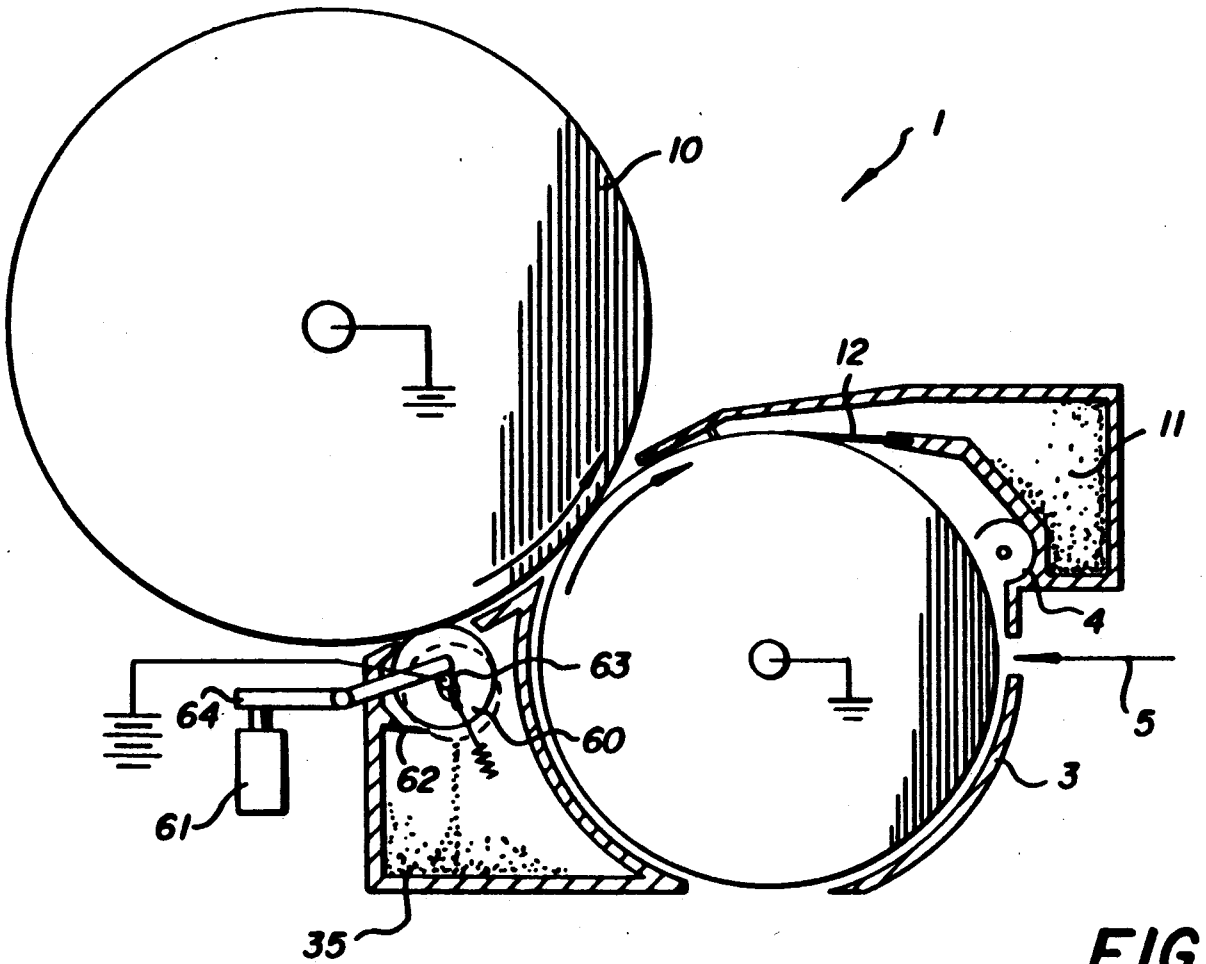
FIGS. 2 and 3 are front schematics similar to FIG. 1 illustrating alternative embodiments of the invention.
Figure 3:
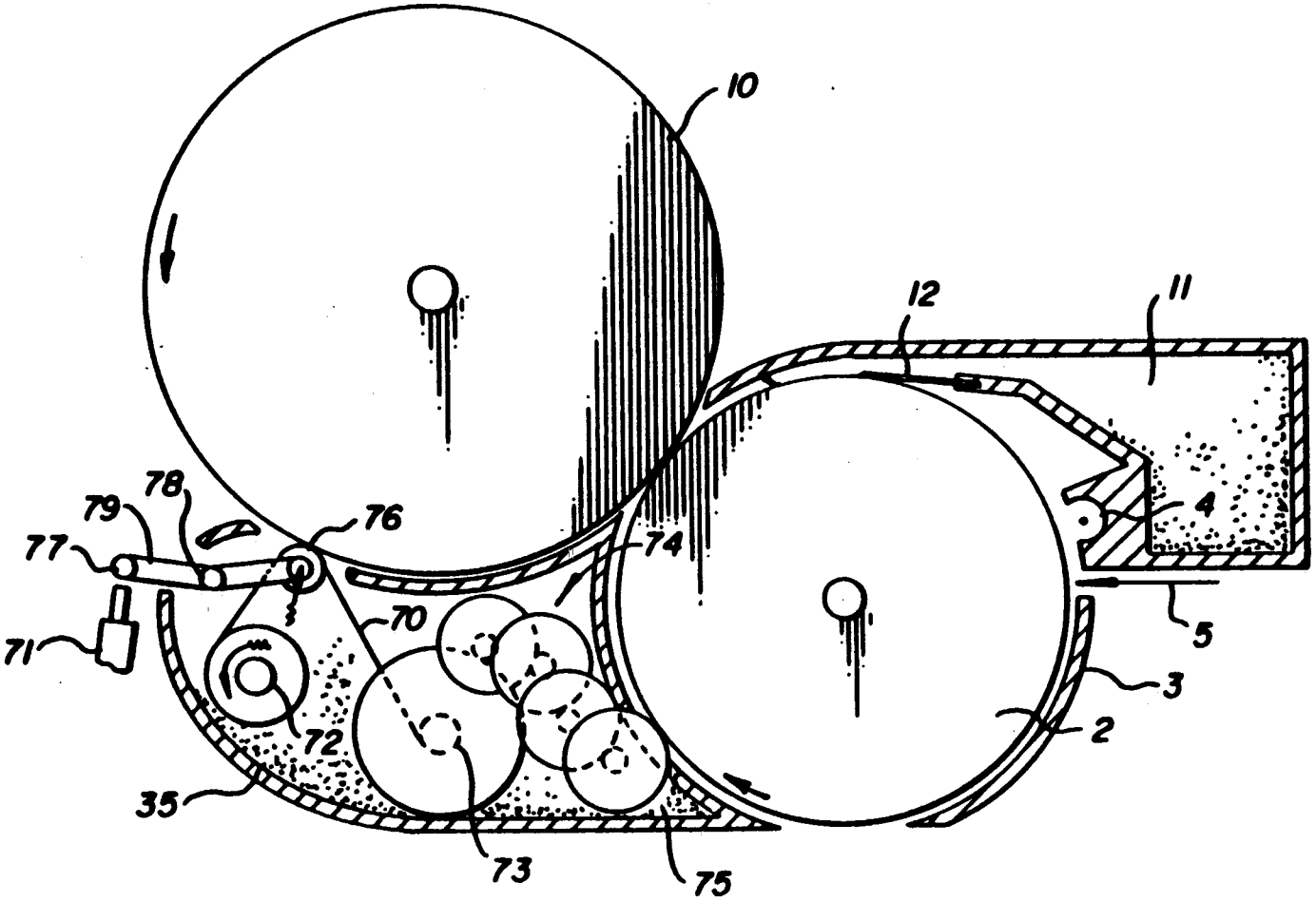

FIGS. 2 and 3 show an alternative approach to cleaning transfer roller 10 which also provides a chamber 35 for receiving toner cleaned off transfer drum 10. In each of the FIGS. 2 and 3 embodiments, the cleaning device is located within cartridge 3. The articulation mechanism is permanent in printer 1.

Referring to FIG. 2, cartridge 3 includes a cleaning roller 60 which is mounted on an elongated shaft 63 which is journaled in bearings which extend beyond cartridge 3. Shaft 63 is spring-urged into engagement with transfer drum 10. Cleaning roller 60 is articulated out of such contact by actuation of a pair of solenoids 61 which rotate lever 64 to engage and move the bearings for shaft 63 away from transfer drum 10 in opposition to its normal spring bias.

In both the FIGS. 1 and 2 devices the cleaning rollers 30 and 60 are rotated by contact with the transfer drum 10 and do not need to be separately driven. However, for best cleaning results, rollers 30 and 60 should be biased to make rollers 30 and 60 more attractive to toner than to transfer drum 10. Transfer drum 10 is ordinarily biased with respect to photoconductive drum 2 to be more attractive to toner to enable transfer of the toner images to transfer drum 10. When cleaning, a still higher bias can be applied to cleaning rollers 30 or 60. Alternatively, transfer drum 10 can be grounded during cleaning, enabling cleaning with a lower bias supplied to rollers 30 and 60. For more details regarding the biasing of transfer drum cleaning rollers, see the aforementioned Ku Patent U.S. Pat. No. 4,862,224.

FIG. 3 shows an alternative embodiment in which a bias is not necessary for cleaning. According to FIG. 3, chamber 35 in cartridge 3 includes a cleaning web 70 which is trained from a supply roll 72 to a take-up roll 73 across a pressure roll 76. Cleaning web 70 is of a conventional cleaning web structure known in the art, for example, of cloth or paper. Supply roll 72 is continually biased by a rotary spring to maintain a slight amount of tension on web 70. Web 70 is indexed by gradual rotation of take-up roller 73 which is driven through a reduction gear train 74 from a drive roller 75 which engages the periphery of drum 2. Thus, drum 2 is driven by the printer, and drum 2 in turn drives roller 75 and take-up roller 73 to gradually index web 70. Web 70 is articulated into and out of contact with transfer drum 10 by a solenoid 71 which rotates a lever 79 in a clockwise direction to move pressure roller 76 against its spring urging and away from transfer drum 10 during multicolor image formation. Solenoid 71 is released for cleaning, during which the spring urging of pressure member 76 causes it to move into transfer drum 10 which then is contacted by web 70 for cleaning. Lever 79 is connected at both ends of roller 76 and pivots about a rod 78 which runs the length of the cartridge 3. Lever 79 terminates in a rod 77 which also runs the length of the cartridge 3 but is external to the cartridge for access to solenoid 71.

With each of the structures shown in FIGS. 1, 2 and 3, the toner cleaned off the transfer member is collected within the cartridge and therefore does not require periodic removal. Instead, it is removed from the image-forming apparatus with the replacement of the cartridge itself.

Although the FIGS. show an apparatus in which single color toner images are transferred directly to the surface of the transfer drum 10, it is also known to place a receiving sheet on the drum 10. In such instance, the receiving sheet is held by gripping fingers, vacuum or electrostatics. The receiving sheet is moved through transfer relation with photoconductive drum 2 repeatedly to superpose the toner images directly on it. The receiving sheet is then separated at a position remote from the position of transfer and fed to a fuser. With such structure it is still necessary to clean the surface of the transfer drum. This invention can be used with such apparatus. However, it has somewhat more utility with the apparatus shown in FIGS. 1-3 because the amount of toner being cleaned is substantially greater when multicolor images are transferred directly to the surface of drum 10 rather than a receiving sheet attached to it.

Although both image member 2 and transfer member 10 are shown as drums, it is also known to utilize endless webs for these two members and to include the image member as an endless web in a cartridge. Although the drums shown in the FIGS. have some advantages over such structure, the invention can be used with an endless web as either or both image member and transfer member.

Although the image-forming apparatus is shown as a printer 1 in the FIGS. in which image formation is accomplished by a laser 5, it can also be any other device in which an image member is used to create toner images. For example, electrostatic images could be created on the image member 2 by imagewise optical exposure or by imagewise ion deposition.

The invention has been described in detail with particular reference to a preferred embodiment thereof, but it will be understood that variations and modifications can be effected within the spirit and scope of the invention as described hereinabove and as defined in the appended claims.

I claim:

1. An image-forming apparatus including:

an image member, a transfer member having a peripheral surface for receiving a toner image from said image member, means for creating an electrostatic image on said image member, means for toning said electrostatic image to create a toner image, means for transferring said toner image to said peripheral surface of said transfer member, means for transferring a toner image from said peripheral surface to a receiving sheet, means for cleaning said transfer member of toner, a single replaceable cartridge, which includes both said image member and means for receiving toner cleaned from said transfer member.

2. An image-forming apparatus including an image member, a transfer member, means for forming a series of electrostatic images on said image member and means for toning each of said series of electrostatic images with toners of a different color to create a series of toner images, means for transferring said toner images in registration to a surface associated with said transfer member to create a multicolor image, means for cleaning said transfer member of toner, and a single replaceable cartridge, which includes both said image member and means for receiving toner cleaned from said transfer member.

3. An image-forming apparatus according to claim 1 wherein said means for creating an electrostatic image includes means for creating a series of electrostatic images and said means for toning said electrostatic images includes means for applying toner of different colors to each of said images of said series, and said means for transferring includes means for transferring said different color toner images to the surface of said transfer member to create a multicolor toner image on the surface of said transfer member and wherein said image-forming apparatus further includes means for transferring said multicolor image to a receiving sheet.

4. In an image-forming apparatus including:

a photoconductive drum, a rotatable transfer drum having a peripheral cylindrical surface mounted in transfer relation with said photoconductive drum, means for uniformly charging the periphery of said photoconductive drum, means for imagewise exposing said photoconductive drum to form a series of electrostatic images thereon, means for applying different color toner to each of said images to form a series of different color toner images, means for transferring said different color toner images to the peripheral surface of said transfer drum in registration to form a multicolor image, means for transferring said multicolor image from said transfer drum to a receiving sheet, means for cleaning untransferred toner from said transfer drum, the improvement including a single replaceable cartridge including said photoconductive drum and a chamber with an opening for receiving toner cleaned off said transfer drum by said cleaning means which cleaning means is a permanent part of said image-forming apparatus.

5. An image-forming apparatus according to claim 4 wherein said cleaning means includes a cleaning roller, movable into rolling engagement with said transfer drum and a cleaning blade engaging said roller for cleaning toner from said cleaning roller, and wherein said opening is directly below the position of engagement of said blade and said cleaning roller.

6. In an image-forming apparatus including:

a photoconductive drum, a rotatable transfer drum having a peripheral cylindrical surface mounted in transfer relation with said photoconductive drum, means for uniformly charging the periphery of said photoconductive drum, means for imagewise exposing said photoconductive drum to form a series of electrostatic images thereon, means for applying different color toner to each of said images to form a series of different color toner images, means for transferring said different color toner images to the peripheral surface of said transfer drum in registration to form a multicolor image, means for transferring said multicolor image from said transfer drum to a receiving sheet, means for cleaning untransferred toner from said transfer drum, the improvement including a single replaceable cartridge including said photoconductive drum, said means for cleaning untransferred toner from said transfer drum, and means for receiving toner cleaned off said transfer drum by said cleaning means.

7. The image-forming apparatus according to claim 6 wherein said cleaning means is a cleaning roller, mounted on a shaft, which shaft extends outside said cartridge and wherein said image-forming apparatus includes means for moving said shaft to move said roller between positions in and out of engagement with said transfer drum.

8. The image-forming apparatus according to claim 6 wherein said cleaning means is a cleaning web mounted in said cartridge and movable in and out of engagement with said transfer drum.

9. The image-forming apparatus according to claim 6 wherein said cleaning means is a cleaning web and said cartridge includes a supply and take-up means for said web, and wherein said cartridge further includes means associated with said photoconductive drum for indexing said take-up means in response to rotation of said photoconductive drum.

10. A cartridge insertable in an image-forming apparatus, which image-forming apparatus includes a transfer drum and means for cleaning said transfer drum, said cartridge including:

an image member having a surface upon which toner images are formable, means defining an opening in said cartridge through which said images are transferable to said transfer drum, and a chamber having an opening for receiving toner cleaned off said transfer drum by said cleaning means.

11. A cartridge insertable in an image-forming apparatus, which image-forming apparatus includes a transfer drum and means for cleaning said transfer drum, said cartridge including:

an image member having a surface upon which toner images are formable, means for uniformly charging said image member, means for cleaning said image member, means defining an opening in said cartridge through which said images are transferable to said transfer drum, and means for receiving toner cleaned off said transfer drum by said transfer drum cleaning means.

12. A cartridge according to claim 11 wherein said means for receiving toner is a chamber having an opening in its top.

13. A cartridge insertable in an image-forming apparatus, which image-forming apparatus includes a transfer drum, said cartridge including:

an image member having a surface upon which toner images are formable, means defining an opening in said cartridge through which said images are transferable to said transfer drum, and a cleaning roller which is movable into and out of engagement with said transfer drum for cleaning said transfer drum.

14. A cartridge according to claim 13 wherein said cleaning roller includes a shaft which extends outside of said cartridge which shaft is movable away from a transfer drum when said cartridge is in an image-forming apparatus.

15. A cartridge insertable in an image-forming apparatus, which image-forming apparatus includes a transfer drum, said cartridge including:

an image member having a surface upon which toner images are formable, means defining an opening in said cartridge through which said images are transferable to said transfer drum, and an indexable cleaning web for cleaning said transfer drum.

16. A cartridge according to claim 15 further including means for indexing said web in response to rotation of said image member.

17. A cartridge insertable in an image-forming apparatus, said cartridge comprising:

a rotatable photoconductive drum, means for uniformly charging said photoconductive drum, an opening through which said photoconductive drum can be exposed to create a series of electrostatic images, an opening through which said electrostatic images can be toned with a plurality of different colored toners, an opening through which said toner images can be transferred to a receiving surface associated with a transfer member, means for cleaning said photoconductive drum, and a chamber having an opening for receiving toner cleaned off a transfer member.

18. A cartridge insertable in an image-forming apparatus, said cartridge comprising:

a rotatable photoconductive drum, means for uniformly charging said photoconductive drum, an opening through which said photoconductive drum can be exposed to create a series of electrostatic images, an opening through which said electrostatic images can be toned with a plurality of different colored toners, an opening through which said toner images can be transferred to a receiving surface associated with a transfer member, means for cleaning toner off a surface of a transfer member, means for cleaning said photoconductive drum, and means for receiving toner cleaned off the transfer member.

19. A cartridge according to claim 18 wherein said cleaning means is a cleaning roller movable into and out of engagement with a surface of a transfer member.

20. A cartridge according to claim 18 wherein said cleaning means is an indexable cleaning web which web is movable into and out of engagement with a surface of a transfer member.

* * * * *